US008407974B2

(12) United States Patent
Fontanazzi et al.

(10) Patent No.: US 8,407,974 B2
(45) Date of Patent: Apr. 2, 2013

(54) MEMBER AND METHOD FOR FORMING SEALED PACKAGES OF POURABLE FOOD PRODUCTS FROM A TUBE OF PACKAGING MATERIAL

(75) Inventors: Paolo Fontanazzi, Modena (IT); Giorgio Mattioli, Modena (IT); Franco Santi, Modena (IT); Stefano Caselli, Modena (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 12/668,532

(22) PCT Filed: Sep. 29, 2008

(86) PCT No.: PCT/EP2008/062996
§ 371 (c)(1),
(2), (4) Date: Jan. 11, 2010

(87) PCT Pub. No.: WO2009/040435
PCT Pub. Date: Apr. 2, 2009

(65) Prior Publication Data

US 2010/0205911 A1 Aug. 19, 2010

(30) Foreign Application Priority Data

Sep. 28, 2007 (EP) ..... 07425602

(51) Int. Cl.
*B65B 61/24* (2006.01)

(52) U.S. Cl. ..... 53/551; 53/375.4; 53/374.9

(58) Field of Classification Search ..... 53/551, 53/552, 374.3, 374.5, 374.6, 375.4, 451, 53/374.9; *B65B 61/24, 9/20*
See application file for complete search history.

(56) References Cited

U.S. PATENT DOCUMENTS 5,970,687 A 10/1999 Katayama et al.

(Continued)

FOREIGN PATENT DOCUMENTS

EP 0 829 425 A2 3/1998
EP 1 526 074 A1 4/2005

OTHER PUBLICATIONS

International Search Report issued by the European Patent Office on Aug. 12, 2008 as the International Searching Authority in International Application No. PCT/EP2008/062996.

(Continued)

*Primary Examiner* — M. Alexandra Elve
*Assistant Examiner* — Eyamindae Jallow
(74) *Attorney, Agent, or Firm* — Buchanan Ingersoll & Rooney PC

(57) ABSTRACT

A forming member for controlling the volume of packages of pourable food products formed from a tube of packaging material and sealed at a number of sections of the tube crosswise to an axis of the tube; the forming member having: a main wall which cooperates cyclically with a first portion of the tube extending between two consecutive sections; and at least one flap extending alongside the wall. The flap is movable, with respect to the wall, between a first position, in which it cooperates with a second portion of the tube, extending between the two consecutive sections, to control the volume, between the two consecutive sections, of the package being formed, and a second position, in which it is detached from the second portion.

23 Claims, 9 Drawing Sheets

U.S. PATENT DOCUMENTS

| | | | | |
|---|---|---|---|---|
| 6,112,498 | A * | 9/2000 | Hansson et al. | 53/69 |
| 6,212,861 | B1 * | 4/2001 | Tsuruta | 53/551 |
| 6,877,295 | B1 * | 4/2005 | Benedetti et al. | 53/451 |
| 7,059,100 | B2 * | 6/2006 | Babini et al. | 53/376.2 |
| 7,748,201 | B2 * | 7/2010 | Poppi | 53/551 |
| 2007/0068122 | A1 | 3/2007 | Poppi | |

OTHER PUBLICATIONS

Written Opinion issued by the European Patent Office on Aug. 12, 2008 as the International Searching Authority in International Application No. PCT/EP2008/062996.

* cited by examiner

MEMBER AND METHOD FOR FORMING SEALED PACKAGES OF POURABLE FOOD PRODUCTS FROM A TUBE OF PACKAGING MATERIAL

TECHNICAL FIELD

The present invention relates to a member and method for forming sealed packages of pourable food products from a tube of packaging material.

BACKGROUND ART

Many pourable food products, such as fruit juice, pasteurized or UHT (ultra-high-temperature treated) milk, wine, tomato sauce, etc., are sold in packages made of sterilized packaging material.

A typical example of this type of package is the parallelepiped-shaped package for liquid or pourable food products known as Tetra Brik Aseptic (registered trademark), which is made by folding and sealing laminated strip packaging material.

The packaging material has a multilayer structure substantially comprising a base layer for stiffness and strength, which may be defined by a layer of fibrous material, e.g. paper, or mineral-filled polypropylene; and a number of layers of heat-seal plastic material, e.g. polyethylene film, covering both sides of the base layer.

In the case of aseptic packages for long-storage products, such as UHT milk, the packaging material also comprises a layer of gas- and light-barrier material, e.g. aluminium foil or ethyl vinyl alcohol (EVOH) film, which is superimposed on a layer of heat-seal plastic material, and is in turn covered with another layer of heat-seal plastic material forming the inner face of the package eventually contacting the food product.

As is known, packages of this sort are produced on fully automatic packaging units, on which a continuous tube is formed from the web-fed packaging material; and the web of packaging material is sterilized in the packaging unit, e.g. by applying a chemical sterilizing agent such as a hydrogen peroxide solution, which is subsequently removed, e.g. evaporated by heating, from the surfaces of the packaging material.

The sterilized web of packaging material is maintained in a closed, sterile environment, and is folded into a cylinder and sealed longitudinally to form a tube.

The tube is fed in a vertical direction parallel to its axis, and is filled continuously with the sterilized or sterile-processed food product.

The packaging unit interacts with the tube to heat seal it at equally spaced cross sections and so form pillow packs connected to the tube by transverse sealing bands.

More specifically, the unit comprises two forming assemblies movable along respective guides, and which interact cyclically and successively with the tube to heat seal the packaging material of the tube.

Each forming assembly comprises a slide which moves up and down along the respective guide; and two jaws hinged at the bottom to the slide and movable between a closed configuration, in which they cooperate with the tube to heat seal it, and an open configuration, in which they are detached from the tube.

More specifically, the jaws of each forming assembly are moved between the open and closed configurations by respective cams.

The movements of the forming assemblies are offset by a half-period. That is, one forming assembly moves up, with its jaws in the open configuration, while the other forming assembly moves down, with its jaws in the closed configuration, to prevent the assemblies from clashing.

The jaws of each forming assembly are fitted with respective sealing members, which cooperate with opposite sides of the tube, and comprise, for example, a heating member; and a member made of elastomeric material and which provides the necessary mechanical support to grip the tube to the required pressure.

Each forming assembly also comprises two forming members with respective forming half-shells hinged to the respective jaws.

Each two forming half-shells move cyclically between an open position, in which they are detached from the tube, and a closed position, in which they contact the tube and fold the portion of the tube between two consecutive sealing sections to define and control the volume of the package being formed.

More specifically, the sealing device of a first forming assembly seals the bottom of the package being formed, and the half-shells of the first forming assembly control the volume of the package while the sealing device of the second forming assembly seals the top of the package being formed.

More specifically, the forming half-shells may be spring-loaded by respective springs into the open position, and have respective rollers, which cooperate with respective cams designed to move the half-shells into the closed position by the time the forming assembly reaches a predetermined position as it moves down.

Each forming half-shell has a C-shaped cross section, and comprises, integrally, a main wall; and two parallel lateral flaps projecting towards the axis of the tube of packaging material from respective opposite end edges of the main wall.

In the closed position, the main walls are located on opposite sides of the tube axis, are parallel to each other, and cooperate with respective first portions of the tube.

In the closed position, the flaps of one half-shell cooperate with respective second portions of the tube to completely control the volume of the package being formed, and, on the opposite side to the relative main wall, face corresponding flaps on the other half-shell.

Though performing excellently on the whole, packaging units of the type described still leave room for further improvement.

More specifically, a need is felt within the industry to minimize relative slide between the half-shells and the tube of packaging material as the half-shells move from the open to the closed position, so as to prevent marking and/or scratching or, at worst, damage of the packaging material.

When the packaging unit is used to form packages of a larger nominal volume than the volume of the pourable food product inside, i.e. partly empty finished packages, the tube-contacting surface of the main wall of each half-shell has a number of projections, which cooperate with the tube of packaging material to expel part of the pourable food product from the volume of the tube eventually forming the package.

A need is felt within the industry to reduce the amount of pourable food product in the packages, i.e. increase the empty volume of the packages, while at the same time preventing, as far as possible, marking caused by the projections interacting with the package material.

DISCLOSURE OF INVENTION

It is an object of the present invention to provide a forming member, for controlling the volume of packages of pourable food products formed from a tube of packaging material and sealed at a number of cross sections of the tube, designed to meet at least one of the above requirements in a straightforward, low-cost manner.

According to the present invention, there is provided a forming member, for controlling the volume of packages of pourable food products formed from a tube of packaging material and sealed at a number of cross sections of the tube, as claimed in Claim 1.

The present invention also relates to a method of forming packages of pourable food products, formed from a tube of packaging material and sealed at a number of cross sections of the tube, as claimed in Claim 15.

BRIEF DESCRIPTION OF THE DRAWINGS

A preferred, non-limiting embodiment of the present invention will be described by way of example with reference to the accompanying drawings, in which:

With reference to FIGS. 3 to 8, number 1 indicates as a whole a packaging unit for producing sealed packages 3 of a pourable food product, such as pasteurized milk or fruit juice, from a tube 2 of sheet packaging material.

BEST MODE FOR CARRYING OUT THE INVENTION

The packaging material has a multilayer structure (not shown), and comprises a layer of fibrous material, normally paper, covered on both sides with respective layers of heat-seal plastic material, e.g. polyethylene. In the case of aseptic packages for long-storage products, such as UHT milk, the packaging material also comprises a layer of gas- and light-barrier material, e.g. aluminium foil or ethyl vinyl alcohol (EVOH) film, which is superimposed on a layer of heat-seal plastic material, and is in turn covered with another layer of heat-seal plastic material forming the inner face of the package eventually contacting the food product.

Tube 2 is formed in known manner by longitudinally folding and sealing a web (not shown) of heat-seal sheet material, is filled by a pipe (not shown) with the sterilized or sterile-processed food product for packaging, and is fed, in known manner not shown, along a vertical path having an axis A.

Unit 1 interacts with tube 2 to heat seal it at equally spaced cross sections and form a number of pillow packs 3 (only shown in FIGS. 3 and 5 to 8) connected to tube 2 by sealing bands crosswise to axis A.

Figure 3:
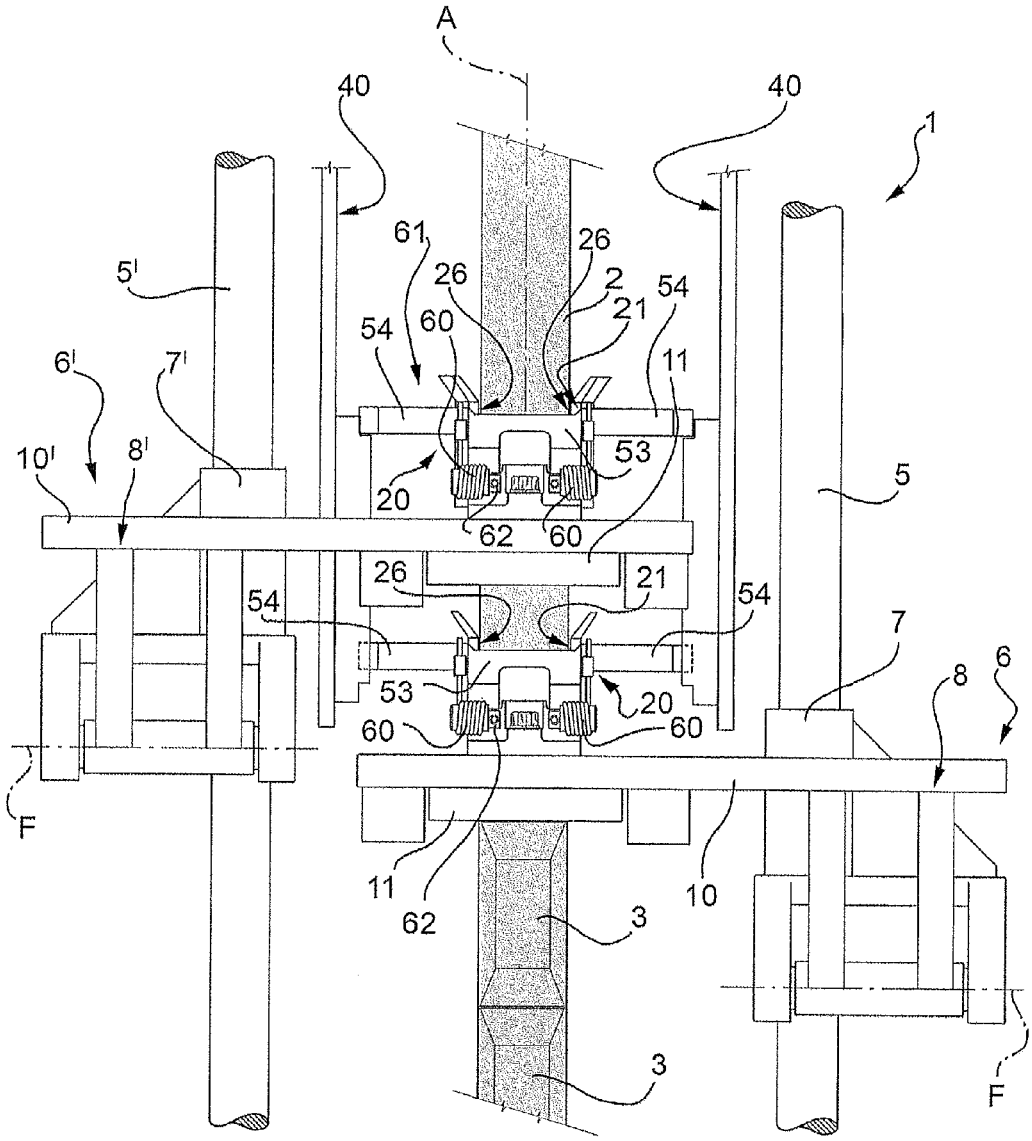
FIG. 3 shows a side view of a packaging unit comprising two pairs of forming members as shown in FIGS. 1 and 2.

With particular reference to FIG. 3, unit 1 comprises two forming assemblies 6, 6', which move vertically along respective vertical cylindrical guides 5, 5' symmetrical with respect to axis A, and interact cyclically with tube 2 to grip and heat seal it along equally spaced cross sections crosswise to axis A.

More specifically, assemblies 6, 6' move upwards along guides 5, 5' from a bottom dead-centre position to a top dead-centre position, and vice versa downwards.

Assemblies 6, 6' being known and identical, only one (assembly 6) is described below, and identical or corresponding parts of assemblies 6, 6' are indicated in the attached drawings using the same reference numbers.

More specifically, assembly 6 substantially comprises a slide 7 (not shown in FIGS. 5 to 8 for the sake of simplicity) that slides along respective guide 5; and two jaws 8 hinged at the bottom to slide 7 about respective horizontal axes F perpendicular to axis A. Jaws 8 are located on opposite sides of tube 2, and are movable, with respect to respective axes F, between a closed configuration (shown in FIGS. 3 and 4 with reference to jaws 8 of assembly 6), in which they grip tube 2, and an open configuration (shown in FIG. 4 with reference to jaws 8' of assembly 6'), in which they are detached from tube 2.

More specifically, each jaw 8 comprises a base portion 10 hinged at its bottom end to a bottom portion of slide 7 about respective axis F; and an arm 11, which interacts with tube 2, is connected to portion 10, and extends perpendicularly to axis A when jaws 8 are closed onto tube 2.

Jaws 8 are therefore moved vertically by slide 7 sliding along guide 5, and open and close with respect to tube 2 of packaging material by rotating about respective axes F about which they are hinged to slide 7; and the open-close movement is superimposed on the up-down vertical movement of slide 7.

The vertical and open-close movements are controlled respectively by known first and second cam actuating devices, not shown by not being essential to a clear understanding of the present invention.

Very briefly, the cam actuating devices provide for rotating jaws 8 in opposite directions and by the same angle about respective axes F.

As shown in FIG. 3, the movements of assemblies 6, 6' are offset by a half-period: assembly 6' travels upwards with jaws 8' open while assembly 6 travels downwards, so that arms 11 of assembly 6 pass between arms 11' of assembly 6' with no interference.

Assembly 6 also comprises a known sealing device, not shown in the drawings, to heat seal each cross section of the tube 2 of packaging material gripped between relative jaws 8.

The sealing device comprises a heating member fitted to arm 11 of one jaw 8, and which interacts with tube 2 by means of two active surfaces; and two pressure pads fitted to arm 11 of the other jaw 8, and which cooperate with respective active surfaces of the heating member to grip and heat seal tube 2.

Assembly 6 also comprises two forming members 20 facing each other on opposite sides of axis A and fitted to respective jaws 8.

Members 20 comprise respective half-shells 21 (FIGS. 1, 2, 4, 9), which are detached from tube 2 as assembly 6, 6' travels upwards, and cooperate with tube 2, during part of the downward travel of assembly 6, 6', to define a space defining the shape and volume of the package 3 being formed between half-shells 21.

Half-shells 21 being identical, only one is described below, and identical or corresponding parts of half-shells 21 are indicated in the attached drawings using the same reference numbers.

More specifically (FIGS. 1-4 and 9), half-shell 21 substantially comprises a flat main wall 25 fixed to a respective jaw 8 and perpendicular to the extension direction of arm 11; and two flaps 26 located on respective lateral sides of wall 25, and both on the axis A side of wall 25.

Wall 25 is bounded by parallel first end edges 27, and by parallel second edges extending between edges 27. More specifically, the second end edges extend perpendicularly to edges 27.

When jaws 8 are in the closed configuration (FIGS. 5 to 9), walls 25 are vertical, parallel to each other, and at a distance with respect to axis A.

In which case, walls 25 cooperate with respective first portions 35 (FIG. 9) of tube 2 extending between two consecutive sealing sections and located on opposite sides of axis A, and edges 27 and the second edges of walls 25 are positioned vertically and horizontally respectively.

Each flap 26 is advantageously movable, with respect to wall 25 of relative member 20, between a first position (FIGS. 4, 7, 9), in which it cooperates with a respective second portion 36, extending between said two sealing sections of tube 2, to control the volume of the package 3 being formed between the two consecutive sealing sections, and a second position (FIGS. 1, 2, 5, 6, 8), in which it is detached from said second portion 36 of tube 2.

Figure 4:
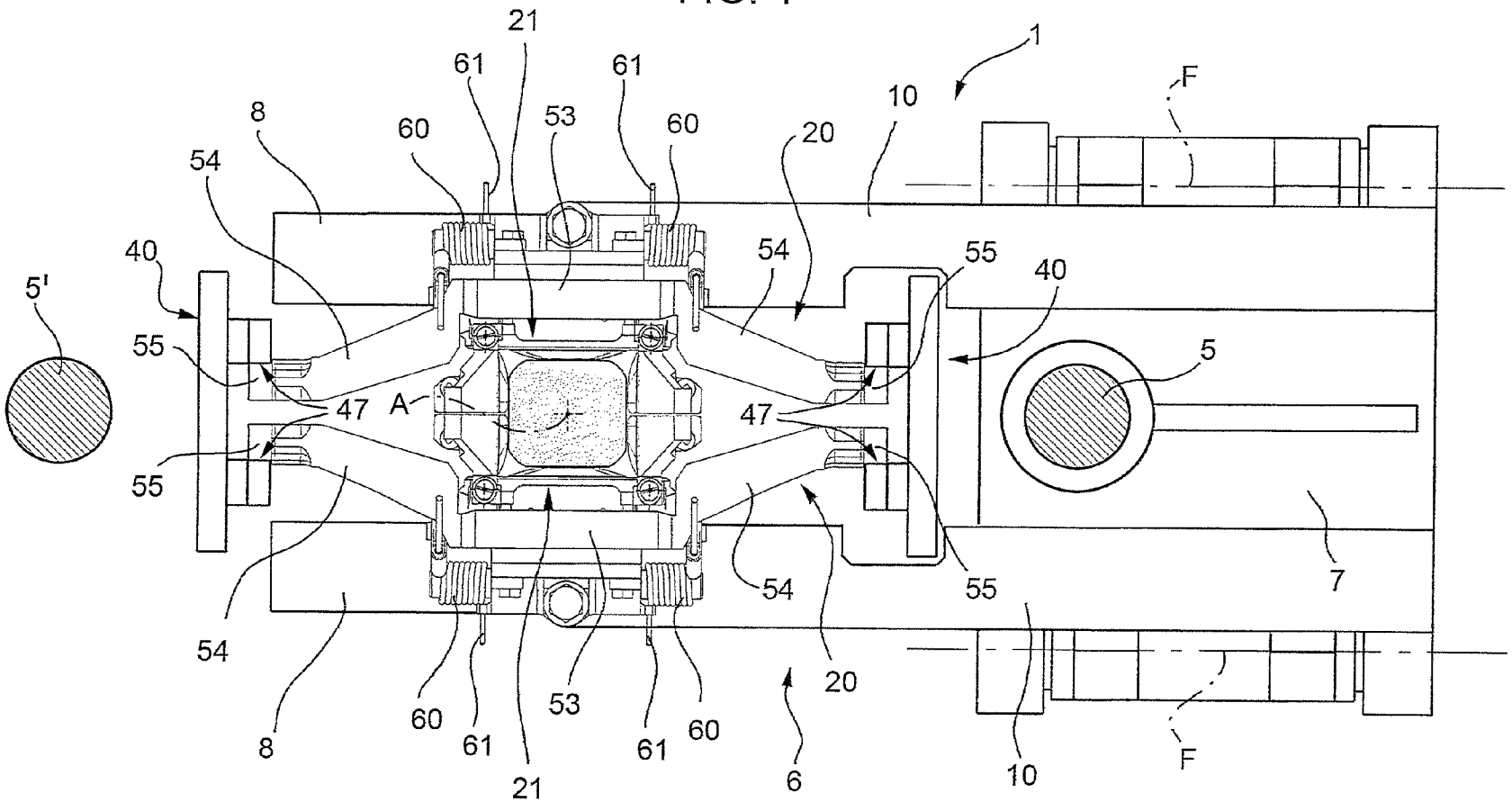
FIG. 4 shows a top plan view of FIG. 3, with parts removed for clarity.
Figure 5:
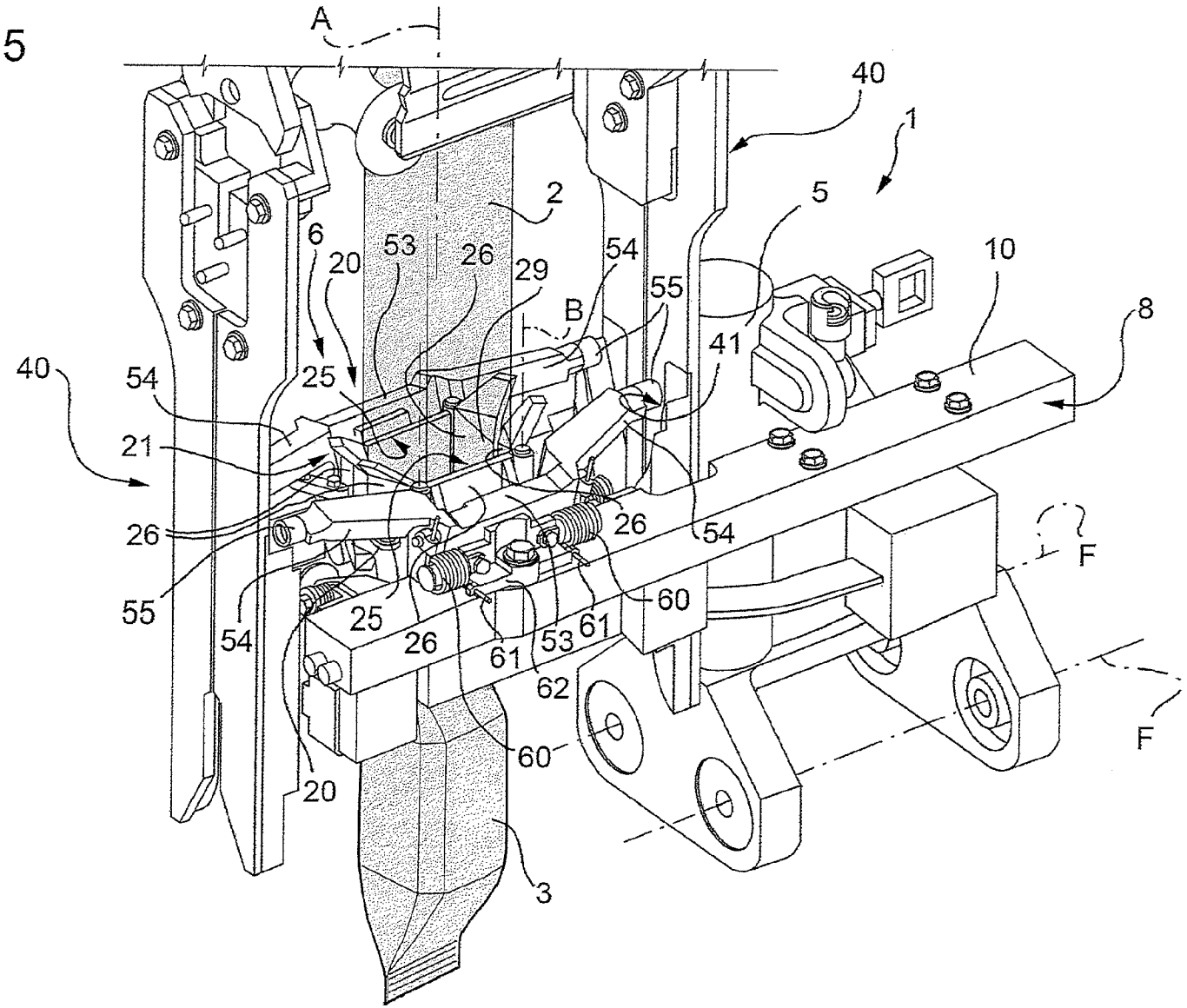
FIGS. 5 and 6 show views in perspective, with parts removed for clarity, of the FIG. 3 unit in successive first and second operating positions.
Figure 6:
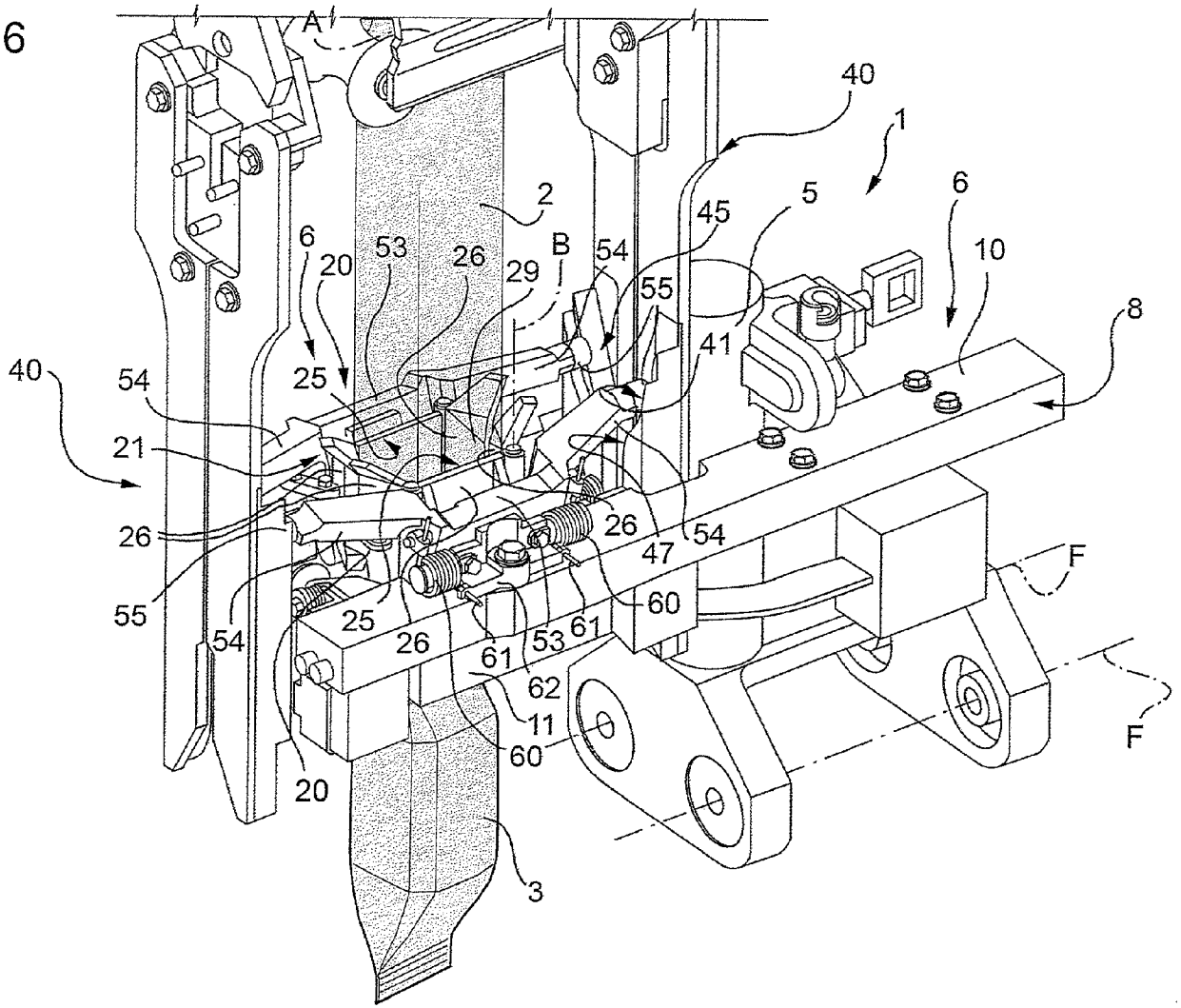
Figure 9:
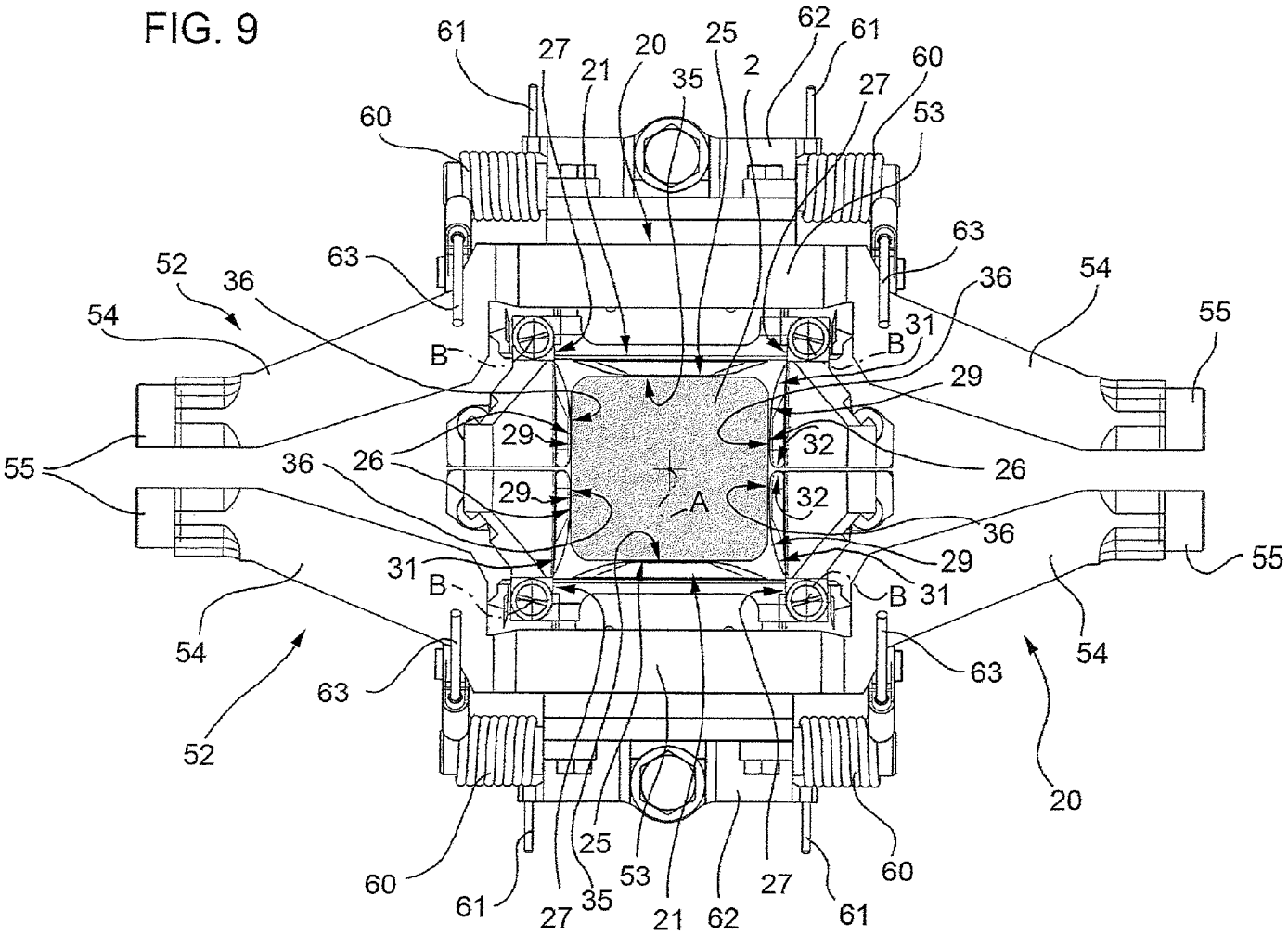
FIG. 9 shows a further view, with further parts removed for clarity, of the packaging unit in the third operating position shown in FIGS. 4 and 7.

Because walls 25 and flaps 26 of members 20 control the volume of package 3 being formed, first portions 35 and second portions 36 lie in respective planes parallel to axis A when respective flaps 26 are in the first position (FIGS. 4 and 9).

More specifically, when flaps 26 are in the first position, first portions 35 are parallel to each other and perpendicular to second portions 36, which are also parallel to each other.

Flaps 26 of each member 20 are loaded elastically into the second position, and, as assembly 6 travels downwards, perform a work cycle comprising, in sequence, a closing stroke (FIGS. 5 and 6), in which flaps 26 approach tube 2, moving from the second position to the first position, and a volume-control stroke is (FIG. 7), in which flaps 26 are in the first position and cooperate with respective second portions 36 of tube 2 to control the volume of the package 3 being formed.

After the closing stroke, flaps 26 of each member 20 perform an opening stroke (FIG. 8), in which they withdraw from tube 2, moving from the first to the second position, and a return stroke, in which flaps 26 remain detached from tube 2.

More specifically, each flap 26 (FIGS. 1, 2, 9) comprises a first surface 29, which interacts with respective second portion 36 of tube 2; and a second surface 30 opposite surface 29.

Each flap 26 comprises a first end edge 31 hinged to a respective edge 27 of wall 25 about an axis B; and a free second edge 32 opposite edge 31.

In the first position (FIGS. 7 and 9), edges 32 of flaps 26 of one half-shell 21 face and are parallel to edges 32 of flaps 26 of the other half-shell 21.

When jaws 8 are in the closed configuration and assembly 6 is travelling downwards, axes B and edges 31 are parallel to axis A.

When flaps 26 are in the first position (FIGS. 7 and 9), surfaces 29, 30 lie in respective planes perpendicular to relative walls 25, and cooperate with respective second portions 36 of tube 2 on opposite sides of axis A.

When flaps 26 are in the second position (FIGS. 5 and 6) surfaces 29 lie in respective planes sloping with respect to axis A, and are detached from respective second portions 36 of tube 2.

More specifically, in the second position, the planes of surfaces 29, 30 of flaps 26 are symmetrical with respect to axis A, and converge from edge 32 towards edge 31.

Flaps 26 also comprise respective trapezium-shaped top ends.

At a given point in the downward travel of assembly 6, members 20 interact with two cams 40 on unit 1 to move each flap 26 from the second to the first position.

When cams 40 interact with members 20, relative jaws 8 are therefore in the closed configuration, and walls 25 cooperate with respective first portions 35 of tube 2.

By the time flaps 26 of each member 20 move into the first position, i.e. resting on respective second portions 36 of tube 2, relative wall 25 therefore already cooperates with respective first portion 35 of tube 2.

With particular reference to FIGS. 1, 2, 4 and 3, each member 20 also comprises:

- two levers 51 extending alongside respective edges 27 of wall 25 and hinged to respective edges 27 about a common axis C;
- a body 52 integral with levers 51 and defined by a crosspiece 53 facing wall 25, on the opposite side to axis A, and by two projections 54 projecting integrally from opposite ends of crosspiece 53 and fitted, on their free ends opposite crosspiece 53, with respective cam follower rollers 55; and
- two connecting rods 56, each interposed between a respective projection 54 and surface 30 of a respective flap 26, to convert integral rotation of body 52 and levers 51 towards wall 25 about axis C into rotation of flaps 26 from the second to the first position about respective axes B.

Each connecting rod 56 comprises two end seats 57 (FIG. 1), one engaged by a first pin integral with relative projection 54, and the other by a second pin integral with relative surface 30.

The first and second pin extend in respective directions sloping with respect to each other at angles that vary as relative flap 26 rotates between the closed and open positions.

Flaps 26 of each member 20 are loaded elastically into the second position by two springs 60 fitted to member 20.

Figure 1:
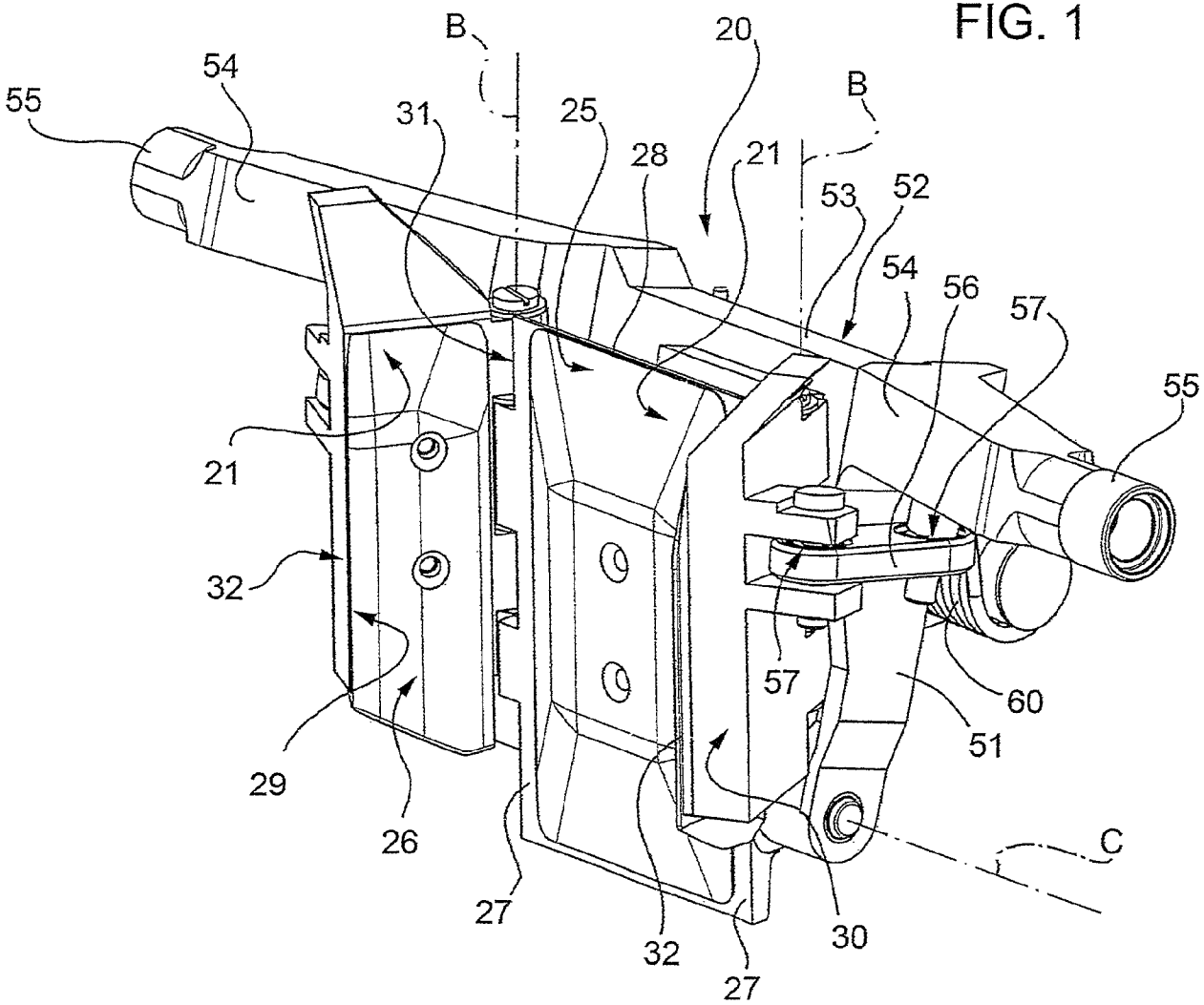
FIGS. 1 and 2 show front and rear views in perspective, respectively, of a forming member in accordance with the present invention.
Figure 2:
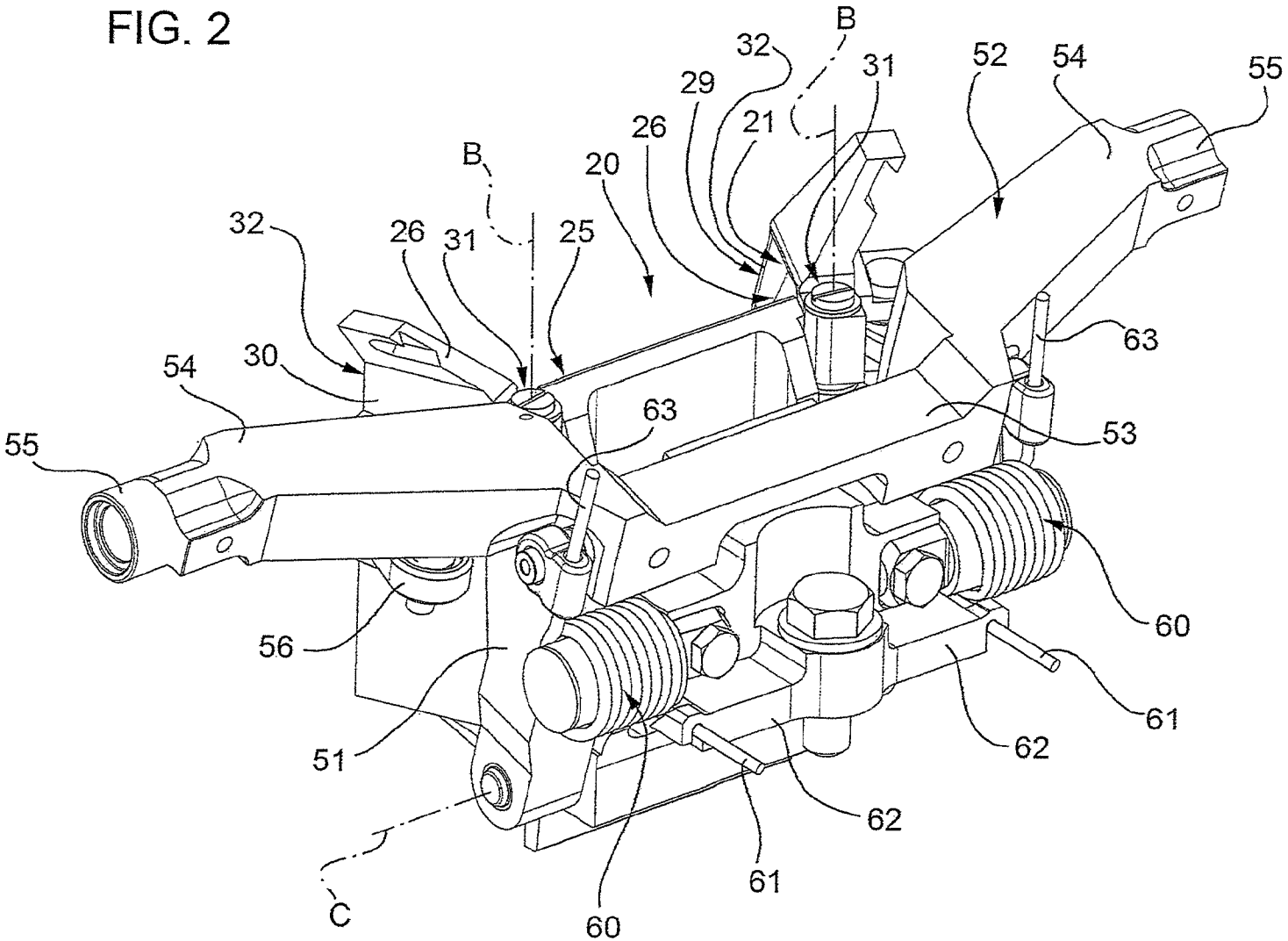

With particular reference to FIGS. 2 and 3, each spring 60 is wound about a respective pin fixed with respect to relative wall 25, and has a first end 61 fixed to a crosspiece 62 projecting integrally from relative wall 25, on the opposite side to axis A, and a second end 63 opposite end 61 and connected functionally to relative crosspiece 53.

More specifically, end 63 of each spring 60 engages a seat defined by a member hinged to crosspiece 53.

Cams 40 (FIGS. 3 to 8) are located on opposite sides of axis A, and each comprise two surfaces 41 facing each other and located on the same side of axis A.

As assembly 6 moves down, one roller 55 of each member 20 cooperates with a relative surface 41 of one cam 40, and the other roller 55 cooperates with a relative surface 41 of the other cam 40.

Cams 40 are positioned so that surfaces 41 interact with relative rollers 55 at a given point in the downward movement of assembly 6 along guide 5.

More specifically, each surface 41 comprises two end portions 45, 46 sloping with respect to axis A; and an intermediate portion 47 between portions 45, 46 and substantially parallel to axis A.

More specifically, portions 45 of surfaces 41 converge, and portions 46 diverge in the downward travelling direction of assembly 6.

Figure 7:
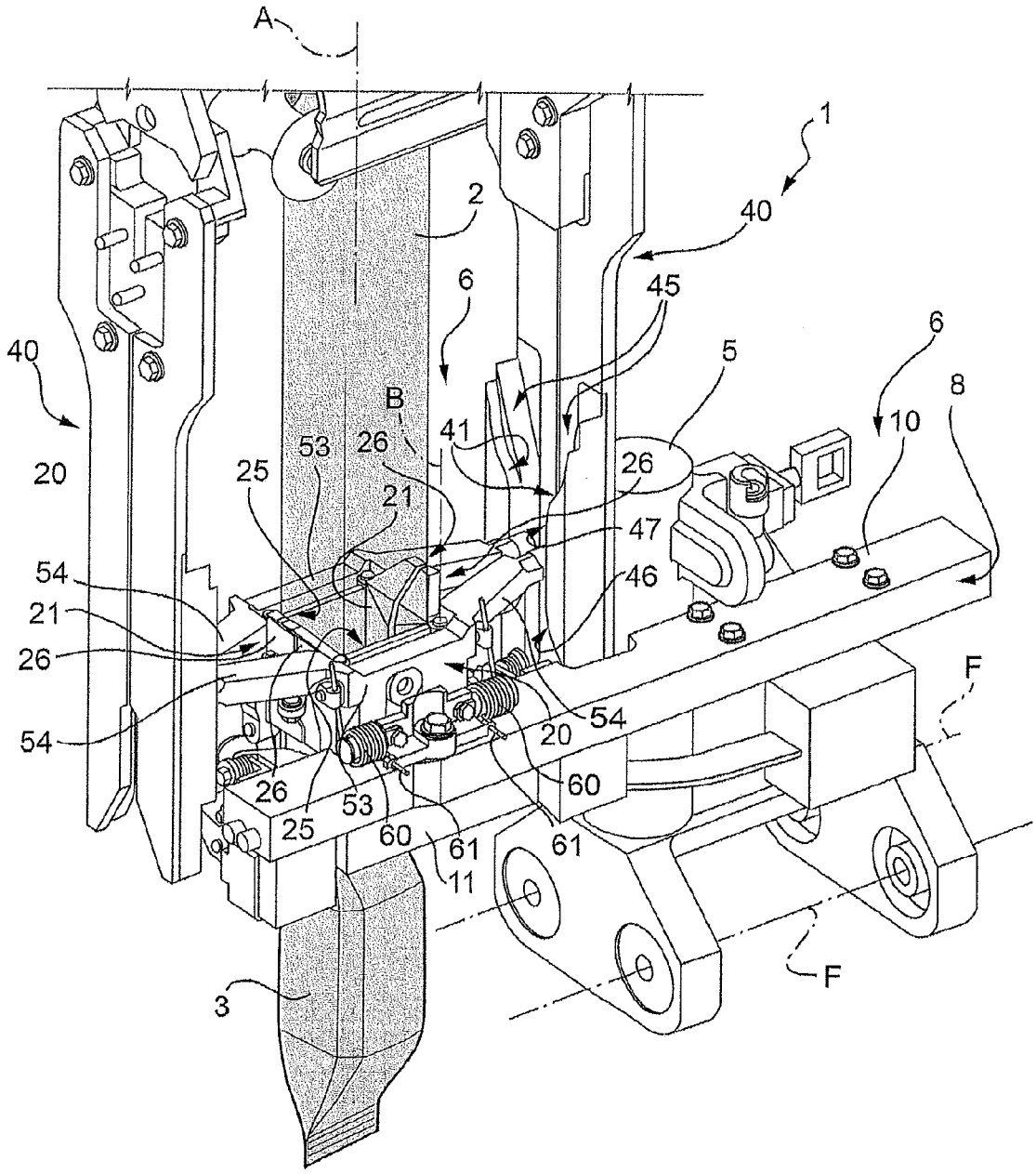
FIG. 7 shows a view in perspective, with parts removed for clarity, of the FIG. 3 unit in a third operating position corresponding to the FIG. 4 condition.
Figure 8:
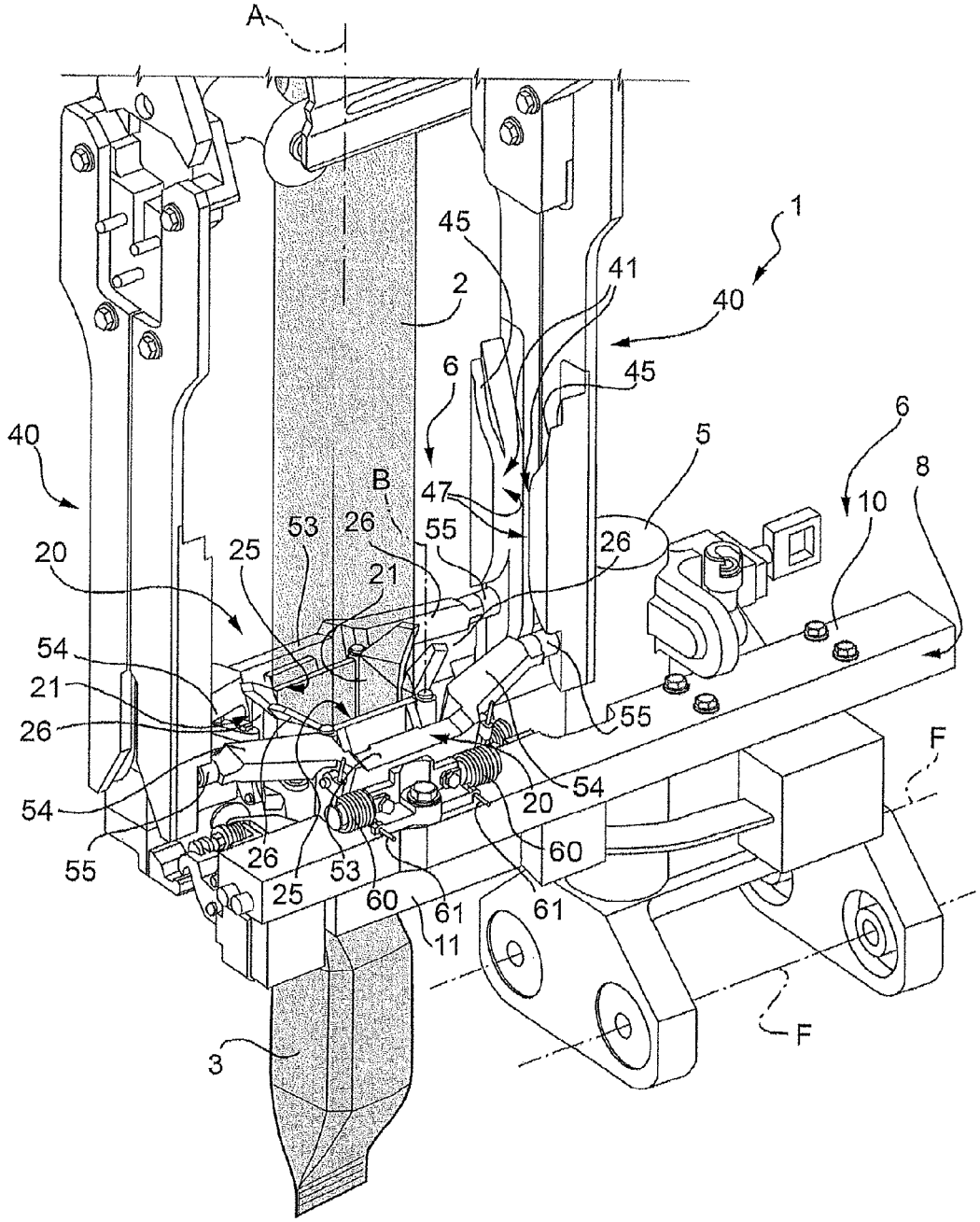
FIG. 8 shows a view in perspective, with parts removed for clarity, of the FIG. 3 unit in a fourth operating position.

As assembly 6 moves down, surfaces 41 of each cam 40 interact with respective facing rollers 55 of relative members 20 to move flaps 26 from the second position (FIGS. 5 and 6) to the first position (FIG. 7).

More specifically, rollers 55 first roll towards each other along portions 45, so that flaps 26 each perform the closing stroke, in opposition to relative springs 60; then roll along portions 47 to keep flaps 26 in the first position; and, finally, roll away from each other along portions 46, so that flaps 26 each perform the opening stroke into the second position, with the aid of relative springs 60.

More specifically, as rollers 55 roll towards each other during the closing stroke, body 52 and levers 51 of each member 20 rotate towards relative wall 25 about relative axis C and in opposition to respective springs 60.

This rotation in turn rotates flaps 26 of each member 20 about respective axes B into the first position by means of connecting rods 56.

Similarly, as rollers 55 roll away from each other, body 52 and levers 51 of each member 20 are rotated by respective springs 60 away from relative wall 25 about relative axis C; which in turn rotates flaps 26 about respective axes B into the second position by means of connecting rods 56.

Cams 40 are also positioned so that, at a given position of assembly 6 along guide 5, rollers 55 disengage cams 40, and springs 60 move respective flaps 26 from the first to the second position.

Surfaces 29 of flaps 26 and wall 25 of each member 20 have projections (not shown), which interact with relative second portions 36 and first portion 35 of tube 2 to expel part of the pourable product from the portion of tube 2 forming package 3 and extending between two consecutive sealing sections.

Said projections therefore provide for forming packages 3 of a larger nominal volume than the food product inside, i.e. partly empty packages.

In actual use, tube 2, filled with the pourable food product, is fed along axis A, and assemblies 6, 6' move up and down, offset by a half-period, along respective guides 5, 5'.

More specifically, as the assemblies move up and down, jaws 8, 8' interact with the relative cam actuating devices to move between the closed configuration, in which they heat seal tube 2 at respective sealing sections, and the open configuration, in which they are detached from tube 2.

More specifically, assembly 6 moves up with jaws 8 open, and, at the same time, assembly 6' moves down with jaws 8' closed, so that arms 11 of assembly 6' pass between aims 11 of assembly 6 with no interference.

Operation of unit 1 is described below with reference to assembly 6 only, and as of the top dead-centre position, in which jaws 8 are in the open configuration.

As of the top dead-centre position, jaws 8 begin moving down, and, as they do so, interact with the respective cam actuating devices to move into the closed configuration.

When jaws 8 are in the closed configuration, walls 25 of forming members 20 cooperate with respective first portions 35 of tube 2, while flaps 26 are maintained in the second position by respective springs 60.

As assembly 6 moves down further, rollers 55 of members 20 (FIGS. 5 and 6) interact, on opposite sides of axis A, with portions 45 of respective cams 40, and so move towards one another.

As a result, levers 51 and body 52 of each member 20 rotate about relative axis C towards relative wall 25.

This rotation is transmitted from projections 54 of each body 52 to respective flaps 26 by respective connecting rods 56, so that flaps 26 rotate about respective axes B into the first position.

More specifically, flaps 26 of each member 20 are in the first position when relative rollers 55 begin cooperating with relative portions 47 (FIG. 7) of relative surfaces 41.

As rollers 55 travel along relative portions 47, flaps 26 of each member 20 are maintained in the first position to permit complete control of the volume of package 3 being formed between two consecutive sealing sections.

Once flaps 26 are set to the first position, the sealing device is activated to seal the bottom of package 3 being formed.

While rollers 55 cooperate with relative portions 47, i.e. while respective flaps 26 are in the first position, the sealing device of jaws 8' seals the top of package 3 being formed.

As the sealing devices are operated, flaps 26 and walls 25 of half-shells 21 cooperate with respective second portions 36 and respective first portions 35 of tube 2 to effectively control the volume and shape of the package 3 being formed between two consecutive sealing sections of tube 2.

As assembly 6 moves down further, rollers 55 of each member 20 (FIG. 8) interact, on opposite sides of axis A, with respective portions 46 of relative surfaces 41, and so move away from one another.

As a result, springs 60 rotate levers 51 and body 52 of each member 20 away from relative wall 25 about axis C.

This rotation is transmitted from projections 54 of each body 52 to respective flaps 26 by respective connecting rods 56, so that flaps 26 rotate about respective axes B into the second position.

As assembly 6 reaches the bottom dead-centre position, jaws 8 move into the open configuration, and walls 25 are detached from respective first portions 35 of tube 2.

Assembly 6 then travels upwards, while assembly 6' travels downwards with jaws 8' in the closed configuration.

The advantages of member 20 and the method according to the present invention will be clear from the above description.

In particular, because flaps 26 move into the first position without sliding along respective second portions 36 of tube 2, friction between second portions 36 and respective flaps 26 is minimized as compared with the known solutions described in the introduction.

As a result, marking and/or scratching of the packaging material of packages 3 is greatly reduced.

Moreover, because flaps 26 move into the first position without sliding on the packaging material of tube 2, flaps 26 may be provided with projections, which interact with second portions 36 of tube 2 to expel part of the pourable product from the portion of tube 2 forming package 3 and bounded laterally by first and second portions 35 and 36, and, parallel to axis A, by two consecutive sealing sections.

As a result, packages 3 can be formed with a much larger nominal volume than the pourable food product inside, without marking the packaging material of the finished packages 3.

Clearly, changes may be made to member 20 and the method as described herein without, however, departing from the scope as defined in the accompanying Claims.

In particular, walls 25 of members 20 may be hinged to respective jaws 8.

In which case, surfaces 41 of cams 40 would interact with respective rollers 55, so that walls 25 cooperate first with respective first portions 35 of tube 2, and flaps 26 subsequently cooperate with respective second portions 36 of tube 2.

Cams 40 may also be replaced by servomotors.

The invention claimed is:

1. A forming member for controlling the volume of packages of pourable food products formed from a tube of packaging material and sealed at a number of sections of said tube crosswise to a first axis of the tube;

said forming member comprising:

a main wall adapted to cooperate cyclically with a first portion of said tube extending between two consecutive said sections;

at least one flap extending alongside said wall;

wherein said flap is movable, with respect to said wall, between a first position, in which it cooperates with a second portion of said tube, extending between the two consecutive said sections, to control the volume, between the two consecutive said sections, of said package being formed, and a second position, in which it is detached from the second portion, elastic means for loading said flap into one of said first position and said second position;

an interaction surface connected operatively to said flap, and which engages a control member to move said flap into the other of said first position and said second position, in opposition to said elastic means;

wherein said flap is hinged to said wall about a second axis;

a body having said interaction surface and hinged to said wall about a third axis distinct from said second axis and which is offset with respect to said interaction surface; and a connecting member interposed between said body and said flap so that rotation of said body about said third axis rotates said flap about the second axis.

2. A forming member as claimed in claim 1, wherein said elastic means load said flap into said second position.

3. A forming member as claimed in claim 2, wherein said flap comprises a first surface cooperating with said second portion in said first position; and a second surface opposite said first surface.

4. A forming member as claimed in claim 1, wherein said flap comprises a first surface cooperating with said second portion in said first position; and a second surface opposite said first surface.

5. A forming member as claimed in claim 4, wherein said first surface of said flap comprises at least one projection which cooperates, in said first position, with said second portion of said tube to expel at least part of the pourable food product from the volume of said tube defined by said first and said second portion and extending between the two consecutive said sections, so as to form a said package filled only partly with said pourable food product.

6. A forming member as claimed in claim 1, wherein said connecting member is a connecting rod connected at opposite ends to said second surface of said flap and to said body respectively; said connecting rod converting rotation of said body towards said wall about said third axis into rotation of said flap from said second position to said first position about said second axis.

7. A forming member as claimed in claim 1, wherein said elastic means are interposed between said body and said flap.

8. A forming member as claimed in claim 1, comprising:

two said flaps, each having a first end edge hinged to said wall;

said flaps cooperating, in said first position, with respective said second portions located on opposite sides of said first axis; and each said flap comprising a second end edge opposite the first end edge, and which, in said first position, faces a second end edge of a further flap carried by a further forming member.

9. A packaging unit for producing sealed packages of pourable food products, comprising:

two jaws movable cyclically between a closed configuration, in which they grip and seal a tube of packaging material at a number of cross sections, and an open configuration, in which they are detached from said tube; and said jaws each having a respective forming member as claimed in claim 1, and being connected to the respective forming members so that, when the jaws are in the closed configuration, the walls of the respective forming members cooperate with respective first portions of said tube, and the respective flaps are movable between said first and said second position.

10. A unit as claimed in claim 9, wherein said wall of at least one of said forming members is fixed with respect to the relative said jaw.

11. A unit as claimed in claim 9, comprising said control member.

12. A unit as claimed in claim 11, wherein said control member is a cam; and in that said interaction surface is defined by a roller cooperating cyclically with a surface of said cam.

13. A forming member for controlling the volume of packages of pourable food products formed from a tube of packaging material and sealed at a number of sections of the tube crosswise to a first axis of the tube, the forming member comprising:

a main wall configured to cooperate cyclically with a first portion of the tube extending between two of the sections which are consecutive;

a pair of flaps hingedly connected to the main wall for rotation about respective second axes spaced apart from one another and from the first axis so that the two flaps are positionable in either a first position, in which the flaps cooperate with respective second portions of the tube extending between the two consecutive sections to control volume between the two consecutive sections of the package being formed, and a second position, in which the flaps are spaced from the respective second portions;

a body hingedly mounted on the main wall to rotate relative to the main wall about a third axis spaced from the first axis and from the second axis;

the body being connected to each of the flaps by a respective connecting member so that rotation of the body about the third axis rotates both of the flaps about the respective second axis;

means for elastically loading each of the flaps into the second positions; and a portion of the body being configured to engage a control member to rotate the body about the third axis in a direction causing both of the flaps to rotate about the respective second axes in opposition to the elastic loading to position both of the flaps in the first position.

14. A forming member as claimed in claim 13, wherein the means for elastically loading comprises a pair of springs.

15. A forming member as claimed in claim 13, wherein the first surface of each flap comprises at least one projection which cooperates, in the first position, with the respective second portions of the tube to expel at least part of the pourable food product from the volume of the tube defined by the first and second portions and extending between the two consecutive sections to form the package.

16. A forming member as claimed in claim 15, wherein each connecting member is a connecting rod having one end portion connected to the second surface of the respective flap and an opposite end connected to the body.

17. A forming member as claimed in claim 13, wherein the elastic means is interposed between the body and the wall.

18. A forming member as claimed in claim 13, wherein the body includes a crosspiece facing the main wall and a pair of projections connected to the crosspiece and extending away from one another.

19. A forming member as claimed in claim 18, wherein the portion of the body configured to engage the control member includes a roller at an end of each of the projections.

20. A forming member as claimed in claim 13, wherein the second axes are vertically extending axes, and the third axis is a horizontally extending axis.

21. A method of forming packages of pourable food products produced from a tube of packaging material fed along a first axis and sealed at a number of sealed sections of the tube cross-wise to the first axis, the method comprising:

moving two main walls, which are connected to respective jaws of respective forming members, cyclically into contact with respective first portions of the tube extending between two consecutive ones of the sealed sections, each of the main walls having a respective flap hinged to an edge of the main wall so that the flap is rotatable relative to the main wall about a second axis parallel to the first axis;

each of the forming members comprising a lever hinged to the edge of one of the main walls so that the lever rotates about a third axis perpendicular to the second axis, each forming member also comprising a body integral with the lever and rotatable together with the lever about the third axis;

rotating the body and the integral lever of each forming member about the respective third axis so that the body and the integral lever rotate toward the respective main wall; and converting the rotation of the body and the integral lever of each forming member about the respective third axis into rotation of the flap of the respective forming member about the second axis to move the flap into contact with a second portion of the tube extending between the two consecutive sealed sections to control the volume of the package being formed between the two consecutive sections.

22. The method according to claim 21, wherein the rotation of the body and the integral lever about the respective third axis is converted into rotation of the flap of the respective forming member about the second axis by way of a connecting member connecting the flap to the body, the connecting member being connected to the flap by a pin.

23. A forming member for controlling the volume of packages of pourable food products formed from a tube of packaging material vertically moving along a first axis and sealed at a number of sections of the tube crosswise to the first axis, the forming member comprising:

a main wall adapted to cooperate cyclically with a first portion of the tube extending between two of the sections arranged consecutive;

at least one flap extending alongside an edge of the main wall and hinged to rotate about a second axis, the second axis being different from the first axis and parallel to the first axis;

the flap being rotatable about the second axis and relative to the main wall between one position in which the flap cooperates with a second portion of the tube extending between the two consecutive sections to control the volume, and a second position in which the flap is out of cooperation with the second portion of the tube;

elastic means for loading the flap into one of the first position and the second position;

an interaction surface connected operatively to the flap and engageable with a control member to move the flap into the other of the first position and the second position in opposition to the elastic means;

a lever hinged to the main wall to rotate relative to the main wall about a third axis, the third axis being perpendicular to the second axis and offset with respect to the interaction surface;

a body integral with the lever to rotate together with the lever about the third axis, the body having the interaction surface; and a connecting member connecting the body and the flap so that integral rotation of the body and the lever about the third axis and toward the main wall is converted into rotation of the flap about the second axis.

* * * * *